US012256875B2

(12) United States Patent
Zuger et al.

(10) Patent No.: US 12,256,875 B2
(45) Date of Patent: Mar. 25, 2025

(54) PORTABLE HARD SURFACE CLEANING APPLIANCE

(71) Applicant: Alfred Kärcher SE & Co. KG, Winnenden (DE)

(72) Inventors: Juergen Zuger, Gerlingen (DE); Saulius Martinkenas, Schwaikheim (DE); Christoph Frohmader, Rieden (DE); Hannes Belz, Backnang (DE); Daniel Krohm, Leutenbach (DE); Christian Stewen, Marbach a. N. (DE)

(73) Assignee: ALFRED KÄRCHER SE & CO. KG, Winnenden (DE)

( * ) Notice: Subject to any disclaimer, the term of this patent is extended or adjusted under 35 U.S.C. 154(b) by 995 days.

(21) Appl. No.: 17/002,440

(22) Filed: Aug. 25, 2020

(65) Prior Publication Data

US 2020/0383532 A1 Dec. 10, 2020

Related U.S. Application Data

(63) Continuation of application No. PCT/EP2018/054673, filed on Feb. 26, 2018.

(51) Int. Cl.
*A47L 1/05* (2006.01)
*A47L 5/24* (2006.01)
(Continued)

(52) U.S. Cl.
CPC *A47L 1/05* (2013.01); *A47L 5/24* (2013.01); *A47L 7/0009* (2013.01);
(Continued)

(58) Field of Classification Search
CPC ..... A47L 1/05; A47L 11/4044; A47L 5/24; A47L 7/0009; A47L 7/0014;
(Continued)

(56) References Cited

U.S. PATENT DOCUMENTS 5,099,545 A * 3/1992 Krasznai ..... A47L 5/24 15/353
10,258,207 B2 4/2019 Stewen et al.
(Continued)

FOREIGN PATENT DOCUMENTS

CN 2521087 11/2002
CN 1699030 11/2005
(Continued)

OTHER PUBLICATIONS

WO-2015007325-A1 translation (Year: 2015).*
WO-2017108090-A1 translation (Year: 2017).*
WO-2013143616-A1 translation (Year: 2013).*

*Primary Examiner* — Marc Carlson
(74) *Attorney, Agent, or Firm* — Womble Bond Dickinson (US) LLP

(57) ABSTRACT

A portable hard surface cleaning appliance is provided, including a suction nozzle having a suction opening at which at least one squeegee lip is arranged, an electrical device having a suction turbine in flow connection with the suction nozzle for suctioning a liquid air mixture from the suction opening, an electric motor, an electronic control system, at least one rechargeable battery, a separating device arranged in the flow path between the suction nozzle and the suction turbine for separating liquid from the suctioned liquid air mixture, and a liquid tank for receiving the separated liquid. The hard surface cleaning appliance includes an inner housing arrangement and an outer housing arrangement, wherein the inner housing arrangement accommodates the separating device and the electrical device, and the outer housing arrangement surrounds the inner housing arrangement.

29 Claims, 11 Drawing Sheets

(51) Int. Cl.
*A47L 7/00* (2006.01)
*A47L 9/06* (2006.01)
*A47L 9/28* (2006.01)

(52) U.S. Cl.
CPC ..... *A47L 7/0019* (2013.01); *A47L 7/0023* (2013.01); *A47L 7/0042* (2013.01); *A47L 9/0626* (2013.01); *A47L 9/2857* (2013.01); *A47L 9/2884* (2013.01)

(58) Field of Classification Search
CPC .... A47L 7/0019; A47L 7/0023; A47L 7/0042; A47L 9/0626; A47L 9/2857; A47L 9/2884
USPC ..... 15/103
See application file for complete search history.

(56) References Cited

U.S. PATENT DOCUMENTS

| | | | | |
|---|---|---|---|---|
| 2005/0257945 | A1 | 11/2005 | Justis et al. | |
| 2016/0095585 | A1* | 4/2016 | Zergiebel | A61B 34/74 606/1 |
| 2016/0128528 | A1* | 5/2016 | Stewen | A47L 1/05 15/344 |
| 2017/0049288 | A1* | 2/2017 | Knutson | A47L 11/4083 |
| 2018/0296044 | A1* | 10/2018 | Venturini | A47L 1/05 |

FOREIGN PATENT DOCUMENTS

| | | | | | |
|---|---|---|---|---|---|
| CN | 204120938 | | 1/2015 | | |
| CN | 105476677 | | 4/2016 | | |
| DE | 202013104011 | U1 * | 11/2013 | | A47L 1/05 |
| EP | 2 227 126 | | 12/2012 | | |
| EP | 2 230 980 | | 12/2012 | | |
| EP | 2 237 711 | | 12/2012 | | |
| EP | 2886029 | A1 * | 6/2015 | | A47L 1/05 |
| EP | 2992798 | A1 * | 3/2016 | | A47L 1/05 |
| EP | 3681361 | B1 * | 4/2023 | | A47L 1/05 |
| FR | 3004328 | A1 * | 10/2014 | | A47L 1/05 |
| GB | 2331919 | A * | 6/1999 | | A47L 1/08 |
| GB | 2566070 | A * | 3/2019 | | A47L 1/05 |
| WO | WO 2013/143616 | | 10/2013 | | |
| WO | WO-2013143616 | A1 * | 10/2013 | | A47L 1/05 |
| WO | WO 2015/007324 | | 1/2015 | | |
| WO | WO 2015/007325 | | 1/2015 | | |
| WO | WO 2015/007327 | | 1/2015 | | |
| WO | WO 2015/007328 | | 1/2015 | | |
| WO | WO-2015007325 | A1 * | 1/2015 | | A47L 1/05 |
| WO | WO-2015103889 | A1 * | 7/2015 | | A47L 1/05 |
| WO | WO-2015113952 | A1 * | 8/2015 | | A47L 1/06 |
| WO | WO 2017/108090 | | 6/2017 | | |
| WO | WO-2017108089 | A1 * | 6/2017 | | A47L 1/05 |
| WO | WO-2017108090 | A1 * | 6/2017 | | A47L 1/05 |
| WO | WO-2018059679 | A1 * | 4/2018 | | A47L 1/05 |

* cited by examiner

PORTABLE HARD SURFACE CLEANING APPLIANCE

CROSS-REFERENCE TO RELATED APPLICATION

This application is a continuation of international application number PCT/EP2018/054673, filed on Feb. 26, 2018, which is incorporated herein by reference in its entirety and for all purposes.

FIELD OF INVENTION

The present disclosure relates to a portable hard surface cleaning appliance, in particular, an appliance for squeegeeing and suctioning a liquid from a hard surface.

BACKGROUND OF THE INVENTION

The invention relates to a portable hard surface cleaning appliance for squeegeeing and suctioning a liquid from a hard surface, in particular from a window pane, comprising a suction nozzle, which has a suction opening at which at least one squeegee lip is arranged, and comprising an electrical device, which has a suction turbine in flow connection with the suction nozzle for suctioning a liquid air mixture from the suction opening, an electric motor, an electronic control system, and at least one rechargeable battery, and comprising a separating device, which is arranged in the flow path between the suction nozzle and the suction turbine for separating liquid from the suctioned liquid air mixture, and comprising a liquid tank for receiving the separated liquid.

A hard surface cleaning appliance of that kind is known e.g. from the publications EP 2 237 711 B1, EP 2 230 980 B1, and EP 2 227 126 B1. By means thereof, a hard surface, in particular a window pane, can be cleaned. The portable hard surface cleaning appliance can be moved with the at least one squeegee lip along the hard surface in the manner of a manual window squeegee, such that liquid can be squeegeed from the hard surface. The liquid collects at the suction opening of the suction nozzle of the portable hard surface cleaning appliance and a mixture of liquid and air can be suctioned from the suction opening. The hard surface cleaning appliance comprises a separating device, by means of which the liquid can be separated from the suctioned liquid air mixture. The separated liquid can be collected in a liquid tank. The hard surface cleaning appliance also comprises an electrical device. The electrical device comprises a suction turbine and an electric motor, which drives the suction turbine, as well as an electronic control system for controlling the electric motor and at least one rechargeable battery for supplying energy to the electric motor. By means of the suction turbine, a suction flow can be achieved which extends from the suction opening via the separating device to the suction turbine. Under the effect of the suction flow, the mixture of liquid and air can be suctioned from the suction opening and fed to the separating device. As already mentioned, the liquid can be separated from the suctioned liquid air mixture and be collected in the liquid tank, which then can be emptied from time to time. The suctioned air can be released by the suction turbine into the surroundings of the hard surface cleaning appliance.

Portable hard surface cleaning appliances of the kind stated at the outset have proven themselves in practice. However, increasingly high requirements are placed on the outer appearance of hard surface cleaning appliances of that kind. The hard surface cleaning appliances should create a high-quality impression and should be able to be easily gripped by the user with his hand and be guided along the hard surface to be cleaned. Moreover, the hard surface cleaning appliances should also fulfill high technical requirements. For example, a good separation action should be ensured, such that the suctioned liquid is collected in the liquid tank and is not unintentionally released into the environment. Liquid should not escape, in particular when the hard surface cleaning appliance is operated upside down or lying down and when it is subject to strong acceleration forces upon moving back and forth along the hard surface to be cleaned. The liquid should also not come into contact with current-conducting electrical components. The technical requirements often can only be insufficiently reconciled with the requirements on the outer appearance. Typical hard surface cleaning appliances thus often comprise a housing which is formed by two housing half-shells that are formed substantially mirror-symmetrically to each other and are screwed to each other, which, for fulfilling the technical requirements on the hard surface cleaning appliances, have a complex structural shape and of which a high degree of dimensional stability and flow-tightness is required. The technical requirements on the hard surface cleaning appliance in many cases restrict the flexibility in the exterior design of the hard surface cleaning appliance.

In accordance with an embodiment of the invention, a portable hard surface cleaning appliance of the kind stated at the outset is further developed in such a way that the exterior design of the hard surface cleaning appliance can be optimized without the technical function of the hard surface cleaning appliance being negatively affected as a result.

SUMMARY OF THE INVENTION

In accordance with an embodiment of the invention, provision is made for the hard surface cleaning appliance to comprise an inner housing arrangement and an outer housing arrangement, wherein the inner housing arrangement accommodates the separating device and the electrical device, and the outer housing arrangement surrounds the inner housing arrangement.

In accordance with the invention, the portable hard surface cleaning appliance comprises an inner housing arrangement and an outer housing arrangement. The inner housing arrangement accommodates the separating device and the electrical device and may have a complex structural shape which can be optimized independently of the exterior design of the hard surface cleaning appliance in such a way that the technical function of the hard surface cleaning appliance is reliably ensured. The inner housing arrangement forms, together with the separating device positioned therein and the electrical device positioned therein, an assembly which fulfills all technical requirements and functions of the portable hard surface cleaning appliance and the fulfillment of these requirements and functions can be tested, for example the flow-tightness, upon assembling the hard surface cleaning appliance.

The inner housing arrangement is surrounded by the outer housing arrangement, which can be optimized largely independently of the technical requirements and functions of the hard surface cleaning appliance, to the effect that the hard surface cleaning appliance has an appealing design and can be easily grabbed by the user with his hand and be guided along the hard surface to be cleaned.

The configuration of the outer housing arrangement is largely independent of the design of the inner housing arrangement, and the two housing arrangements can be optimized for their respective functions. The inner housing arrangement can be produced and preassembled together with the components positioned therein in large quantities in a cost-effective manner. Depending on the requirement that is placed on the exterior design of the hard surface cleaning appliance, different outer housing arrangements may then be used, which surround the inner housing arrangement.

It is advantageous if the inner housing arrangement comprises a separating housing, in which the separating device is arranged and which comprises a first separating housing part and a second separating housing part that are connectible to each other in a liquid-tight manner.

The separating housing may form a separating chamber, in which at least one separating element, for example a baffle plate, is arranged. The suctioned liquid air mixture can then be fed to the separating chamber, wherein the liquid then strikes the separating element and is thereby separated from the suctioned liquid air mixture.

It is advantageous if the two separating housing parts are connectible to each other in a first joining direction, wherein arranged on one of the two separating housing parts is a first sealing element which is pressable perpendicularly to the joining direction against at least one first sealing face that is arranged on the other of the two separating housing parts. The two separating housing parts can thus be joined in the first joining direction, and the seal of the connection region of the two separating housing parts is achieved by means of the first sealing element, which, upon joining the two separating housing parts, is pressed against at least one first sealing face in a pressing direction oriented perpendicularly to the first joining direction. Pressing the first sealing element against the at least one first sealing face perpendicularly to the joining direction has the advantage that the joining of the separating housing parts in the first joining direction can take place with significant tolerances, and a reliable sealing effect can nonetheless be achieved. The two separating housing parts may e.g. be screwed or latched to each other, wherein they do not necessarily have to adopt an exact relative position in relation to the first joining direction after joining, because the sealing effect of the first sealing element is effected by pressing perpendicularly to the first joining direction rather than in the first joining direction. By means of a configuration of that kind, a high tightness can thus be achieved in the connection region between the two separating housing parts, while taking dimensional tolerances and assembly tolerances into account.

Provision may be made for one of the two separating housing parts to comprise an annular groove with a groove base and with two groove walls arranged at a distance from each other, wherein at least one groove wall forms a first sealing face, and for the first sealing element to be arranged on the other of the two separating housing parts and, upon joining the two separating housing parts, to dip into the annular groove and be pressable against the at least one first sealing face.

The sealing element is favorably fixed to a separating housing part, in particular molded onto a separating housing part. For example, the first sealing element may be fixed to the second separating housing part, in particular be molded onto the second separating housing part.

It is advantageous if the first sealing element and a separating housing part, in particular the second separating housing part, together form an injection molded part with two components. The sealing element may form a soft component of the injection molded part and the separating housing part may form a hard component of the injection molded part. In an embodiment of that kind, the first sealing element is produced in combination with a separating housing part in a two-component injection molding process. The first sealing element may in particular be made of a rubber-like plastics material and in particular an ABS material may be used for the separating housing part.

The first separating housing part preferably consists of the same material as the second separating housing part. In particular, both separating housing parts may consist of an ABS material.

Preferably, the first sealing element is configured as a first sealing ring closed in itself, which surrounds a first planar surface region oriented perpendicularly to the first joining direction. The first sealing element thus forms the periphery of a first planar surface region. This facilitates the production of the first sealing element and also the joining of the two separating housing parts.

In an advantageous embodiment of the invention, arranged outside of the first surface region are first fixing elements for fixing the first separating housing part to the second separating housing part. By positioning the first fixing elements outside of the first surface region, additional measures for sealing the first fixing elements can be omitted. In particular, it is not necessary for additional sealant to have to be used for the first fixing elements in order to ensure the tightness of the separating housing.

The first fixing elements preferably have latching elements and/or screw elements. Provision may thus be made for the two separating housing parts to be latchable to each other and/or screwable to each other. In particular, provision may be made for latching elements, which cooperate with complementarily formed latching elements of the other separating housing part in the sense of a latching connection, to be arranged on one of the two separating housing parts. Alternatively or in addition, provision may be made for the two separating housing parts to be connected to each other by means of connecting screws.

A separating housing part, in particular the first separating housing part, is, in a preferable embodiment of the invention, releasably connectible to the suction nozzle, in particular pluggably connectible.

In particular, provision may be made for the suction nozzle to comprise a suction conduit and for a separating housing part, preferably the first separating housing part, to be pluggably connectible to an end portion of the suction conduit.

A separating housing part, in particular the first separating housing part, favorably comprises an inlet channel into which an end portion of a suction conduit of the suction nozzle can be plugged.

The mixture of liquid and air can be fed to the separating housing by way of the suction conduit, such that the separation of liquid from the suctioned liquid air mixture can take place within the separating housing. As already mentioned, for this purpose the separating housing may form a separating chamber in which at least one separating element is arranged.

In an advantageous embodiment of the invention, a separating housing part, in particular the second separating housing part, comprises an air outlet, by way of which the separating housing is in flow connection with the suction turbine. The suction flow caused by the suction turbine passes through the separating housing and the suctioned air is able to flow via the air outlet to the suction turbine and be released by the latter into the environment of the hard surface cleaning appliance via at least one opening.

It is advantageous if a separating housing part, in particular the second separating housing part, comprises a liquid outlet, by way of which the separating housing is in connection with the liquid tank. The liquid separated from the liquid air mixture in the separating housing can reach the liquid tank by way of the liquid outlet.

In a particularly preferable embodiment of the hard surface cleaning appliance in accordance with the invention, the inner housing arrangement comprises an electrical housing in which the electrical device is arranged and which comprises a first electrical housing part and a second electrical housing part, which are connectible to each other in a liquid-tight manner. The suction turbine, the electric motor, the electronic control system, and the at least one rechargeable battery are positioned in the electrical housing, and due to the liquid-tight connection of the two electrical housing parts, the risk is low that liquid is able to penetrate the electrical housing via the connection region of the two electrical housing parts.

The two electrical housing parts are preferably connectible to each other in a second joining direction, wherein arranged on one of the two electrical housing parts is a second sealing element which is pressable perpendicularly to the second joining direction against at least one second sealing face that is arranged on the other of the two electrical housing parts. For assembling the electrical housing, the two electrical housing parts are joined in the second joining direction and upon joining, the connection region between the two electrical housing parts is sealed by the second sealing element, wherein the second sealing element is pressed in a pressing direction oriented perpendicularly to the second joining direction against the second sealing face. The two electrical housing parts may e.g. be screwed or latched to each other, wherein they do not necessarily have to adopt an exact relative position in relation to the first joining direction after joining, because the sealing effect of the second sealing element is effected by pressing perpendicularly to second joining direction rather than in the second joining direction. By means of a configuration of that kind, a high tightness can thus be achieved in the connection region between the two electrical housing parts, while taking dimensional tolerances and assembly tolerances into account.

Preferably one of the two electrical housing parts comprises an annular groove with a groove base and with two groove walls arranged at a distance from each other, wherein at least one groove wall forms a second sealing face, and the second sealing element is arranged on the other of the two electrical housing parts and, upon joining the two electrical housing parts, dips into the annular groove and is pressable perpendicularly to the second joining direction against at least one second sealing face.

The second sealing element is favorably fixed to an electrical housing part, in particular molded onto an electrical housing part.

In particular, provision may be made for the second sealing element and an electrical housing part to together form an injection molded part with two components. The second sealing element may form a soft component of the injection molded part and the electrical housing part may form a hard component of the injection molded part. In an embodiment of that kind, the second sealing element is produced in combination with an electrical housing part in a two-component injection molding process, wherein different plastics may be used. The second sealing element may be made of a rubber-like plastics material and the electrical housing part may be made e.g. of an ABS material.

The first electrical housing part preferably consists of the same material as the second electrical housing part. In particular, both electrical housing parts may consist of an ABS material.

It is particularly advantageous if the second sealing element is configured as a second sealing ring closed in itself, which surrounds a second planar surface region oriented perpendicularly to the second joining direction. In an embodiment of that kind, the second sealing element extends along the periphery of the second planar surface region. This facilitates the production of the second sealing element and also the assembly of the electrical housing.

Preferably second fixing elements are arranged outside of the second surface region for fixing the first electrical housing part to the second electrical housing part. The positioning of the second fixing elements outside of the second surface region has the advantage that no additional sealant needs to be used for the second fixing elements in order to ensure the liquid-tight connection of the two electrical housing parts. The liquid-tight connection of the two electrical housings is instead ensured by the second sealing ring closed in itself, the sealing effect of which is not impaired by the provision of the second holding elements.

The second fixing elements preferably have latching elements and/or screw elements. Provision may thus be made e.g. for the two electrical housing parts to be latchable to each other and/or screwable to each other. Thus, latching elements which cooperate with each other in the sense of a latching connection may be arranged on the two electrical housing parts. For example, latching projections may be arranged on one of the two electrical housing parts, said latching projections engaging behind associated latching elements of the other electrical housing part. Alternatively or in addition, e.g. connecting screws may be used, such that the two electrical housing parts can be screwed to each other.

In an advantageous embodiment of the invention, an electrical housing part, in particular the first electrical housing part, comprises a motor receptacle into which the electric motor is insertable. The motor receptacle may form e.g. a sleeve which surrounds the electric motor in the circumferential direction.

The electric motor preferably comprises a motor housing which surrounds a stator and a rotor.

For positioning the suction turbine, in an advantageous embodiment of the invention, an electrical housing part, in particular the first electrical housing part, comprises a turbine receptacle into which the suction turbine is insertable.

It is particularly advantageous if the turbine receptacle is coverable by the separating housing. Provision may thus be made e.g. for the first separating housing part or the second separating housing part to form a lid for the turbine receptacle.

For positioning the at least one rechargeable battery, an electrical housing part, in particular the first electrical housing part, in an advantageous embodiment of the invention, comprises a battery receptacle into which the at least one rechargeable battery is insertable.

It is particularly advantageous if the hard surface cleaning appliance in accordance with the invention comprises two rechargeable batteries which extends along a longitudinal axis of the battery receptacle.

In an advantageous embodiment of the invention, the electronic control system of the hard surface cleaning appliance is insertable into an electrical housing part, in particular into the second electrical housing part, and comprises at least one circuit board on which electrical components are arranged.

The electronic control system is preferably configured as an electronic control, switch, and charging system.

The electronic control system preferably comprises at least one light-emitting element which is arranged on a circuit board, and an electrical housing part, in particular the second electrical housing part, comprises a housing portion which covers the at least one light-emitting element and is light-transmissible. The at least one light-emitting element may be configured e.g. as a light-emitting diode and in particular may serve to display the charge state of the at least one battery to the user. The light emitted by the at least one light-emitting element is able to pass through the light-transmissible housing portion of the electrical housing part in order to display e.g. the charge state to the user.

The at least one light-emitting element preferably forms a display device on which plain text can be displayed, for example at least one digit and/or at least one letter. The user can thus read plain text from the display device, which shows e.g. an operating state of the hard surface cleaning appliance, in particular the charge state and/or the remaining runtime of the at least one battery.

It is advantageous if the separating housing is releasably connectible to the electrical housing. In particular, provision may be made for the separating housing to be screwable and/or latchable to the electrical housing.

No details have yet been specified regarding the configuration of the outer housing arrangement. Provision may be made e.g. for the outer housing arrangement to comprise an outer housing jacket which is formed by a first outer housing part and a second outer housing part and surrounds the inner housing arrangement in the circumferential direction.

The outer housing arrangement preferably comprises a third outer housing part which covers an underside of the inner housing arrangement remote from the suction nozzle. The third outer housing part may form e.g. a standing surface for the hard surface cleaning appliance, such that the hard surface cleaning appliance can be stood in an upright position on a placement surface.

In an advantageous embodiment, the first outer housing part and the second outer housing part together form a handle of the hard surface cleaning appliance which the user can grip with his hand.

It is favorable if an outer housing part forms a grip opening through which the user can reach with his fingers.

The subsequent description of an advantageous embodiment of the hard surface cleaning appliance in accordance with the invention serves in conjunction with the drawing for further explanation.

DETAILED DESCRIPTION OF THE INVENTION

Figure 1:
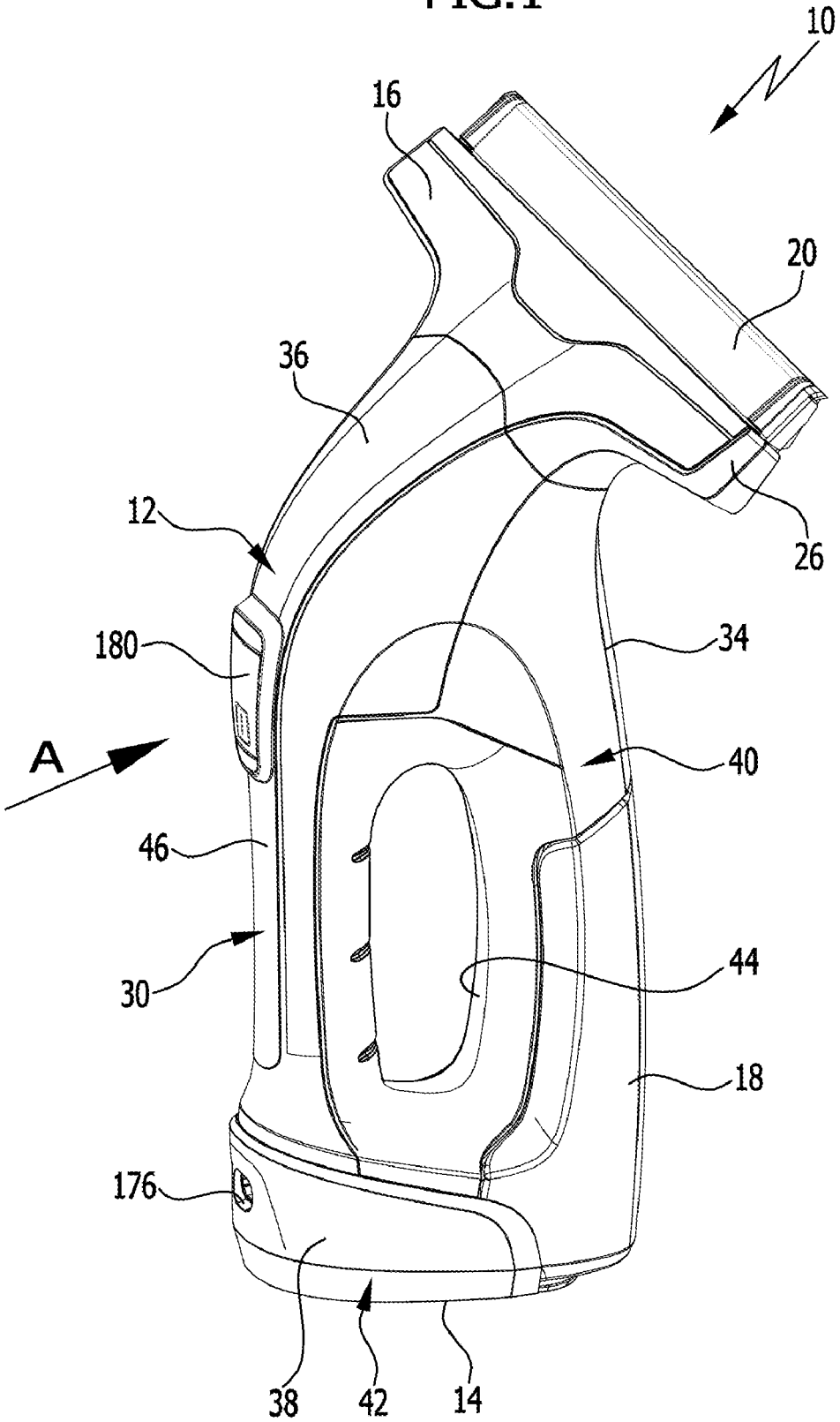
FIG. 1 shows a perspective depiction of a portable hard surface cleaning appliance.
Figure 2:
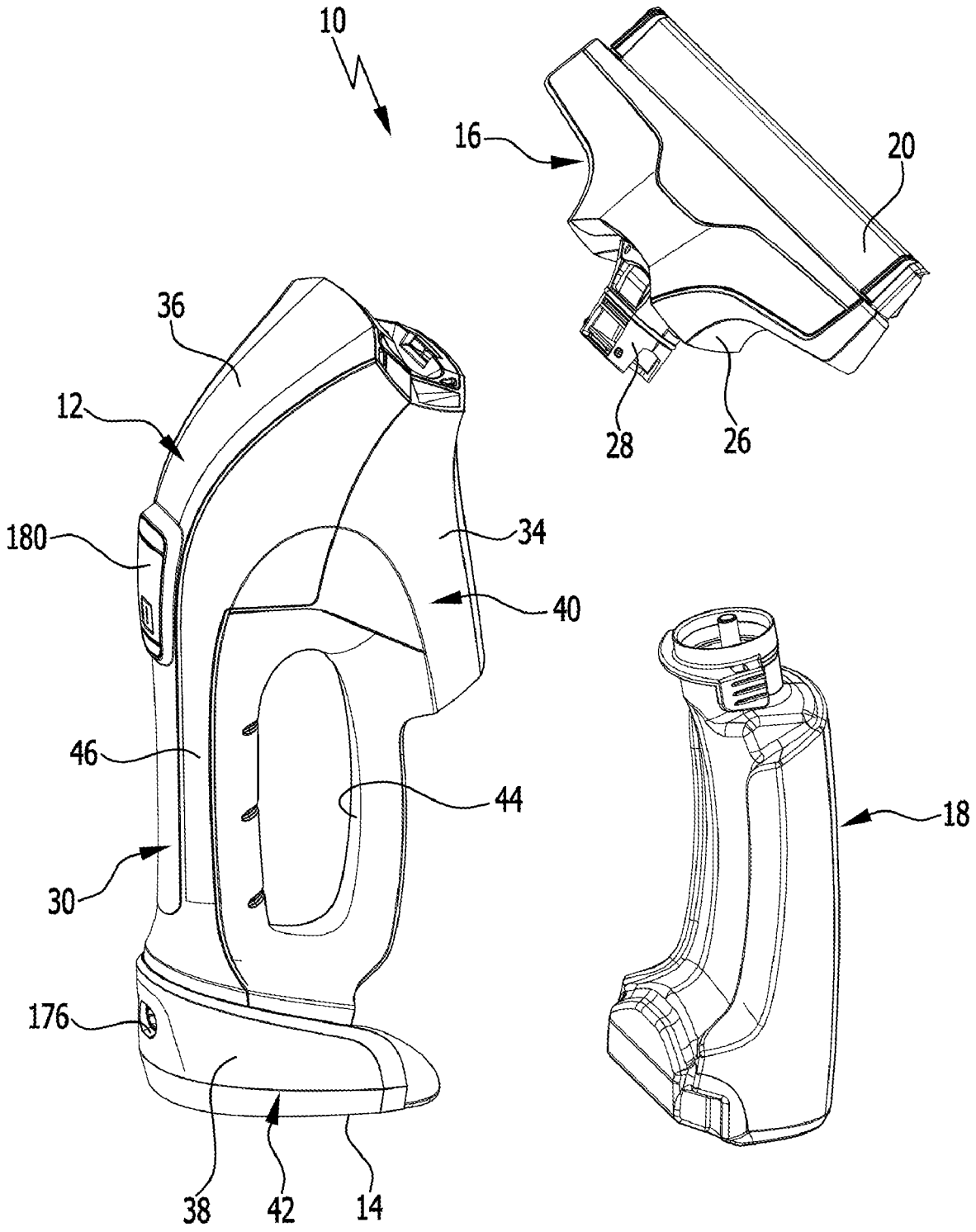
FIG. 2 shows a perspective depiction of the hard surface cleaning appliance from FIG. 1, wherein a suction nozzle and a liquid tank are separated from a base body of the hard surface cleaning appliance.
Figure 3:
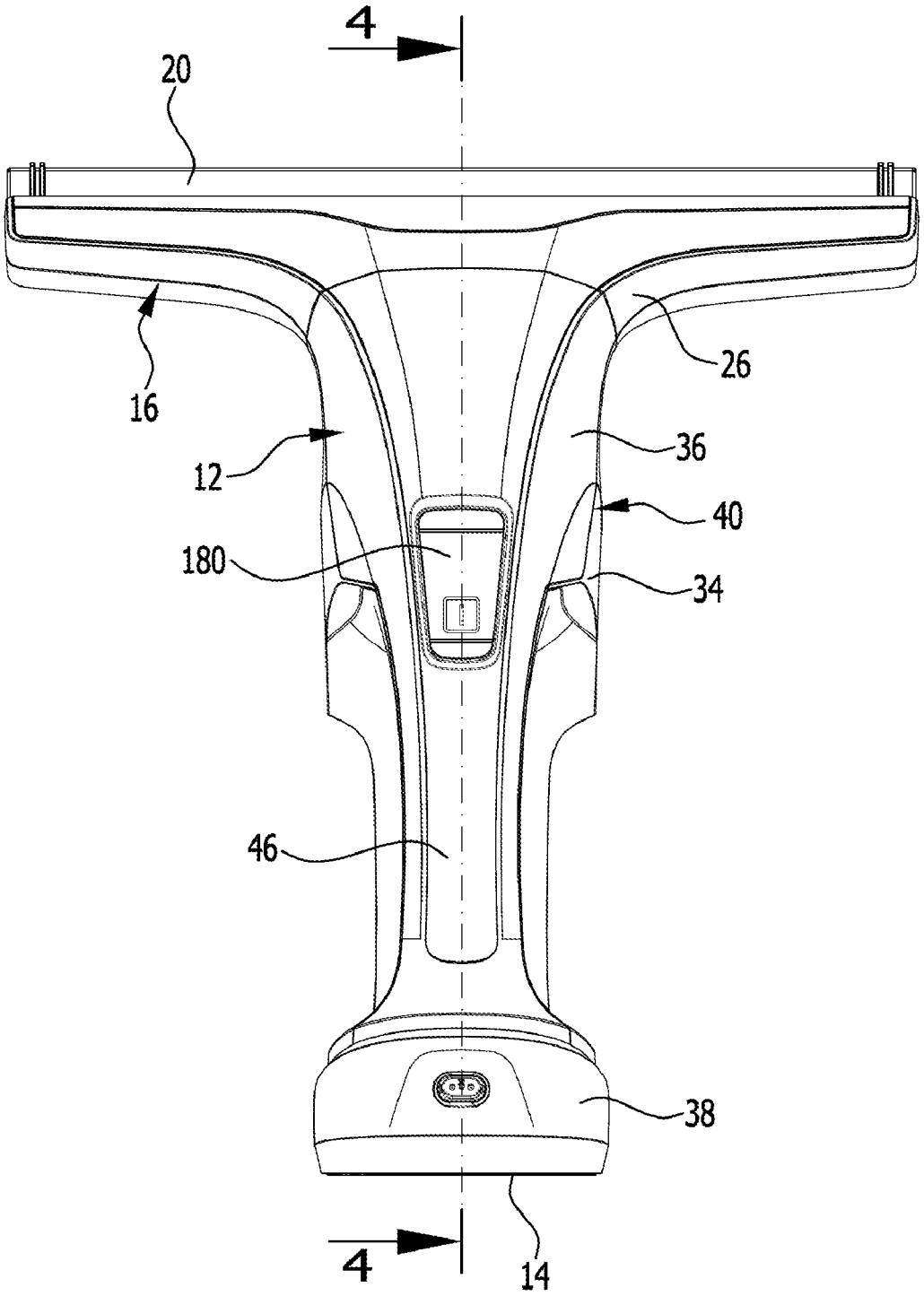
FIG. 3 shows a side view of the hard surface cleaning appliance in the direction of arrow A from FIG. 1, wherein the liquid tank has been hidden.

Schematically depicted in the drawing is an advantageous embodiment of a portable hard surface cleaning appliance which is designated as a whole with the reference numeral 10. By means of the portable hard surface cleaning appliance 10, liquid can be squeegeed and suctioned from a hard surface, in particular from a window pane. Even mirror surfaces or tiled walls or, for example, a smooth table surface can be cleaned by means of the portable hard surface cleaning appliance 10.

The hard surface cleaning appliance 10 can be moved by the user along the hard surface in the manner of a manual window squeegee. The hard surface cleaning appliance 10 forms, in particular, a portable window cleaning appliance.

Figure 4:
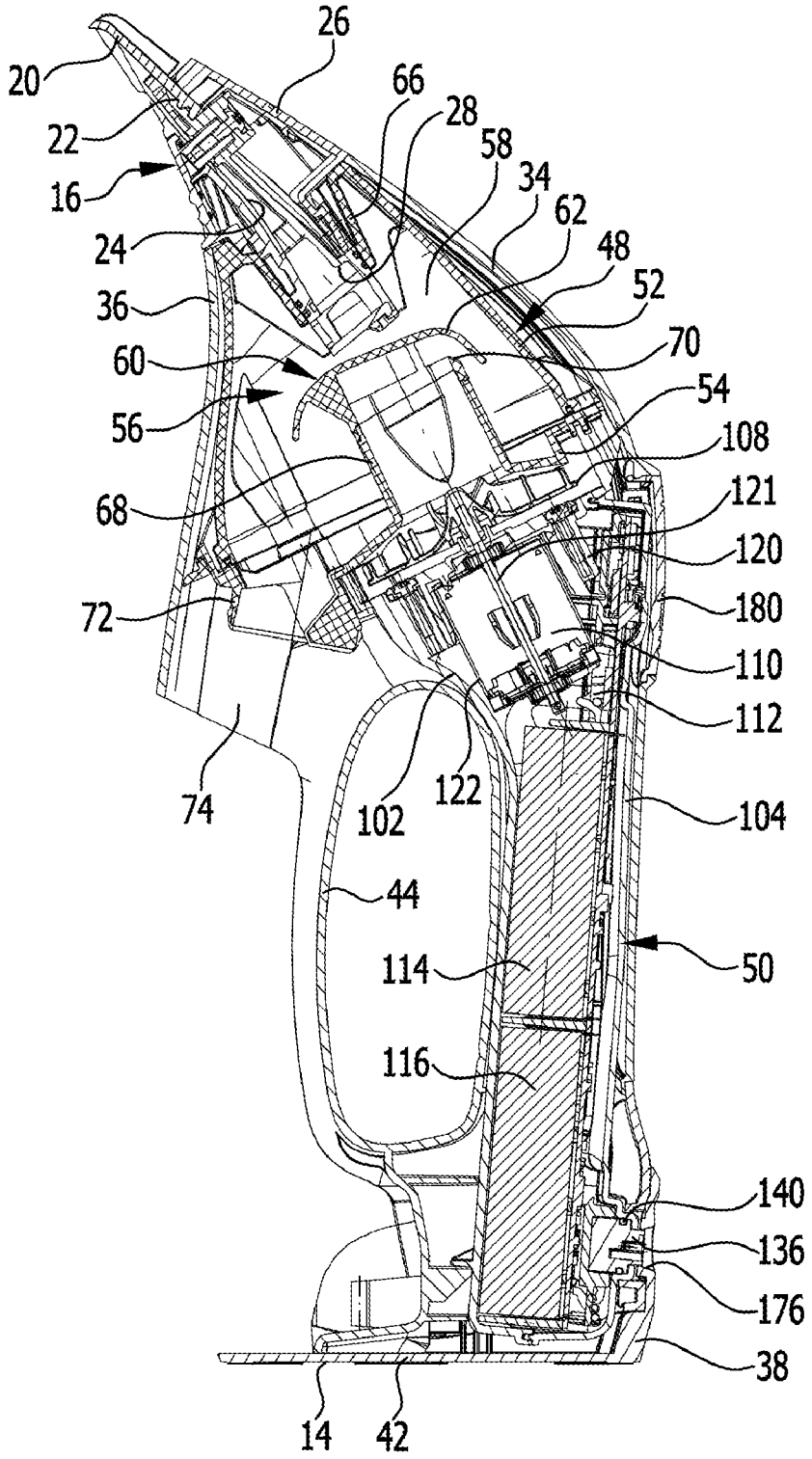
FIG. 4 shows a sectional view of the hard surface cleaning appliance along line 4-4 in FIG. 3.
Figure 5:
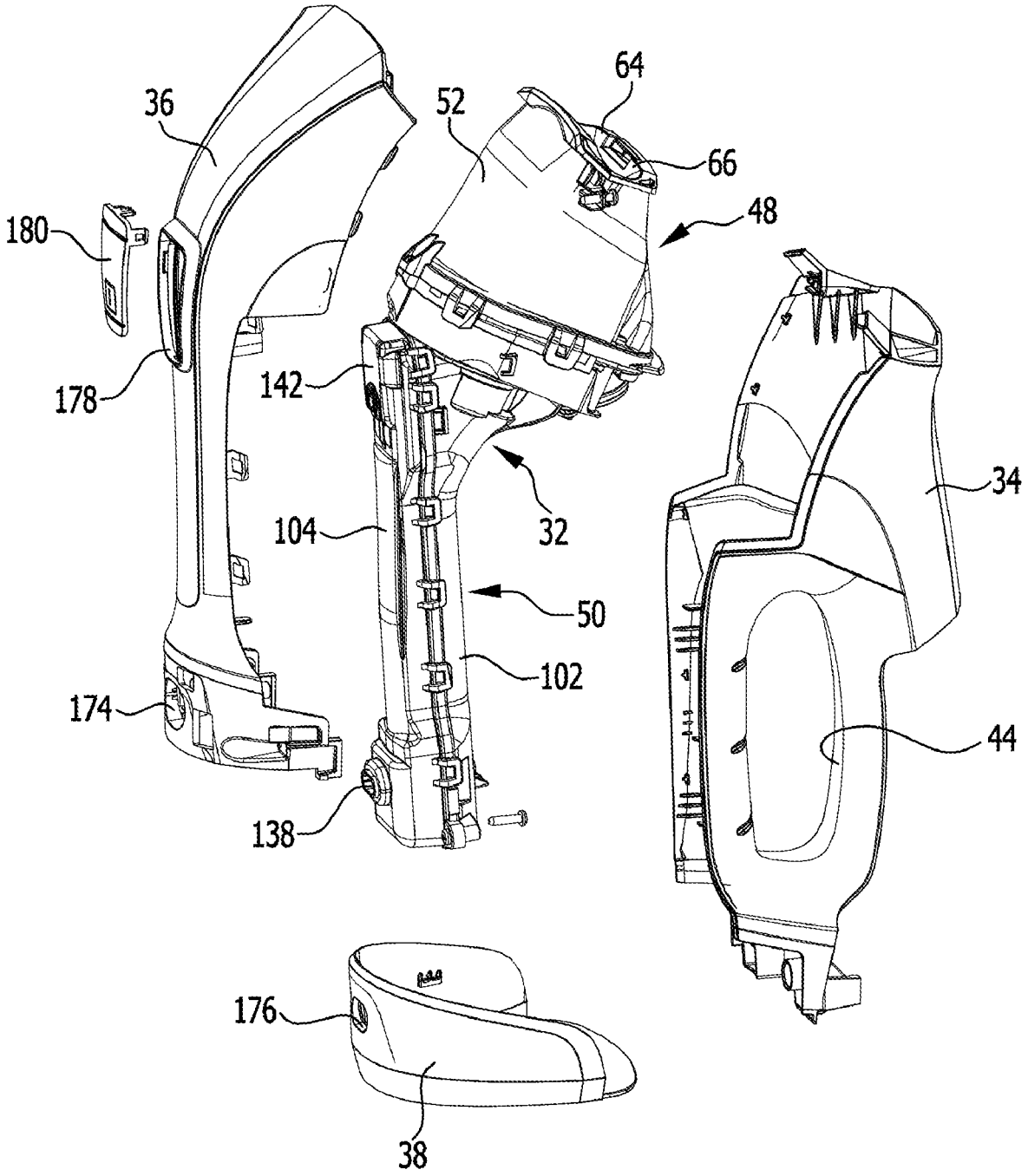
FIG. 5 shows a perspective depiction of the base body of the hard surface cleaning appliance in the manner of an exploded illustration.
Figure 6:
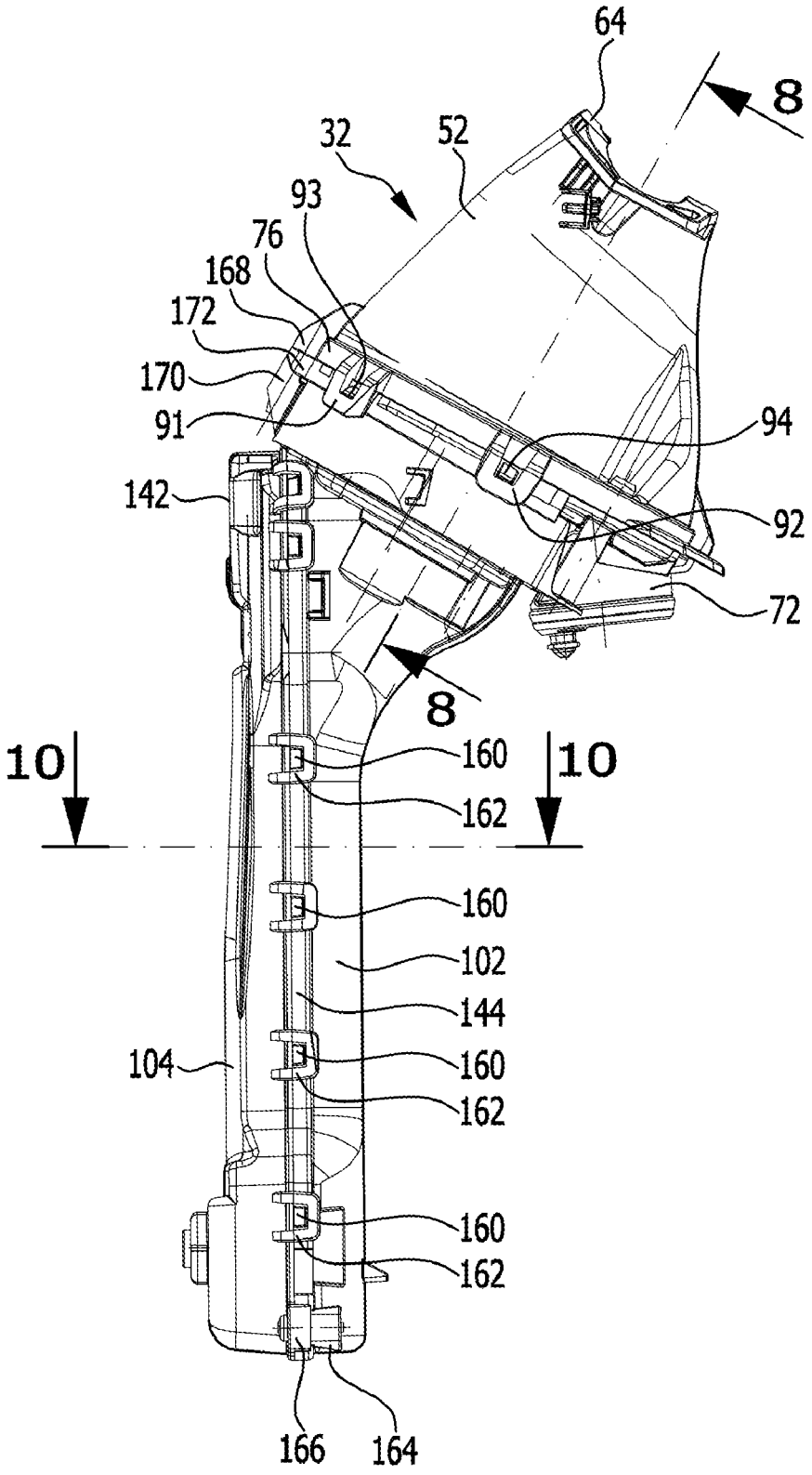
FIG. 6 shows a side view of an inner housing arrangement of the hard surface cleaning appliance from FIG. 1.

The hard surface cleaning appliance 10 comprises a base body 12. The base body 12 comprises a standing surface 14 on its bottom, such that the hard surface cleaning appliance 10 can be stood in an upright position, as it is depicted in particular in FIGS. 1 and 4, on a placement surface.

In addition to the base body 12, the hard surface cleaning appliance 10 comprises a suction nozzle 16 and a liquid tank 18, which are releasably connectible to the base body 12.

The suction nozzle 16 comprises on its free end remote from the base body 12 a flexible squeegee lip 20, which is held at a suction opening 22. This is made clear in particular in FIG. 4. The suction opening 22 is adjoined by a suction conduit 24, which passes through a suction nozzle housing 26 and protrudes with its end portion 28 remote from the squeegee lip 20 out of the suction nozzle housing 26.

In the embodiment depicted, the base body 12 comprises a three-part outer housing arrangement 30 in which an inner housing arrangement 32 is arranged. The outer housing arrangement 30 is formed by a first outer housing part 34, a second outer housing part 36, and a third outer housing part 38. The first outer housing part 34 forms in combination with the second outer housing part 36 an outer housing jacket 40, which completely surrounds the inner housing arrangement 32 in the circumferential direction. The third outer housing part 38 forms an outer housing base 42, which forms the standing surface 14 and covers the underside of the inner housing arrangement 32.

The first outer housing part 34 forms a grip opening 44 and together with the second outer housing part 36 the first outer housing part 34 forms a handle 46, which the user can grip with his hand, wherein he can reach his fingers through the grip opening 44.

The inner housing arrangement 32 comprises a separating housing 48 and an electrical housing 50, which are releasably connected to each other. In the embodiment depicted, the separating housing 48 is screwed to the electrical housing 50. This is described in more detail below.

The separating housing 48 is formed by a first separating housing part 52 and a second separating housing part 54. Arranged within the separating housing 48 is a separating device 56 which comprises a separating chamber 58 surrounded by the first separating housing part 52 and the second separating housing part 54, and comprises a separating element 60 arranged within the separating chamber 58, which in the embodiment depicted is configured as a baffle plate 62.

The first separating housing part 52 is configured in the manner of a hood and the second separating housing part 54 is of substantially plate-like configuration. The first separating housing part 52 comprises on its upper side 64 facing toward the suction nozzle 16 an inlet channel 66 into which the end portion 28 of the suction conduit 24 dips.

The second separating housing part 54 comprises an air outlet channel 68 which projects into the separating chamber 58 and which bears on its free end arranged within the separating chamber 58 the separating element 60 that, in the embodiment depicted, is latchable to the air outlet channel 68. Arranged between the separating element 60 and the air outlet channel 68 is an air inlet opening 70 covered by the separating element 60, by way of which the suction air can flow from the separating chamber 58 into the air outlet channel 68.

The second separating housing part 54 also forms a liquid outlet channel 72 which projects into a tank receptacle 74 that is delimited by the first outer housing part 34 and the third outer housing part 38. The liquid tank 18 can be inserted into the tank receptacle 74 and, for example for emptying, the liquid tank 18 can be removed from the tank receptacle 74.

Figure 7:
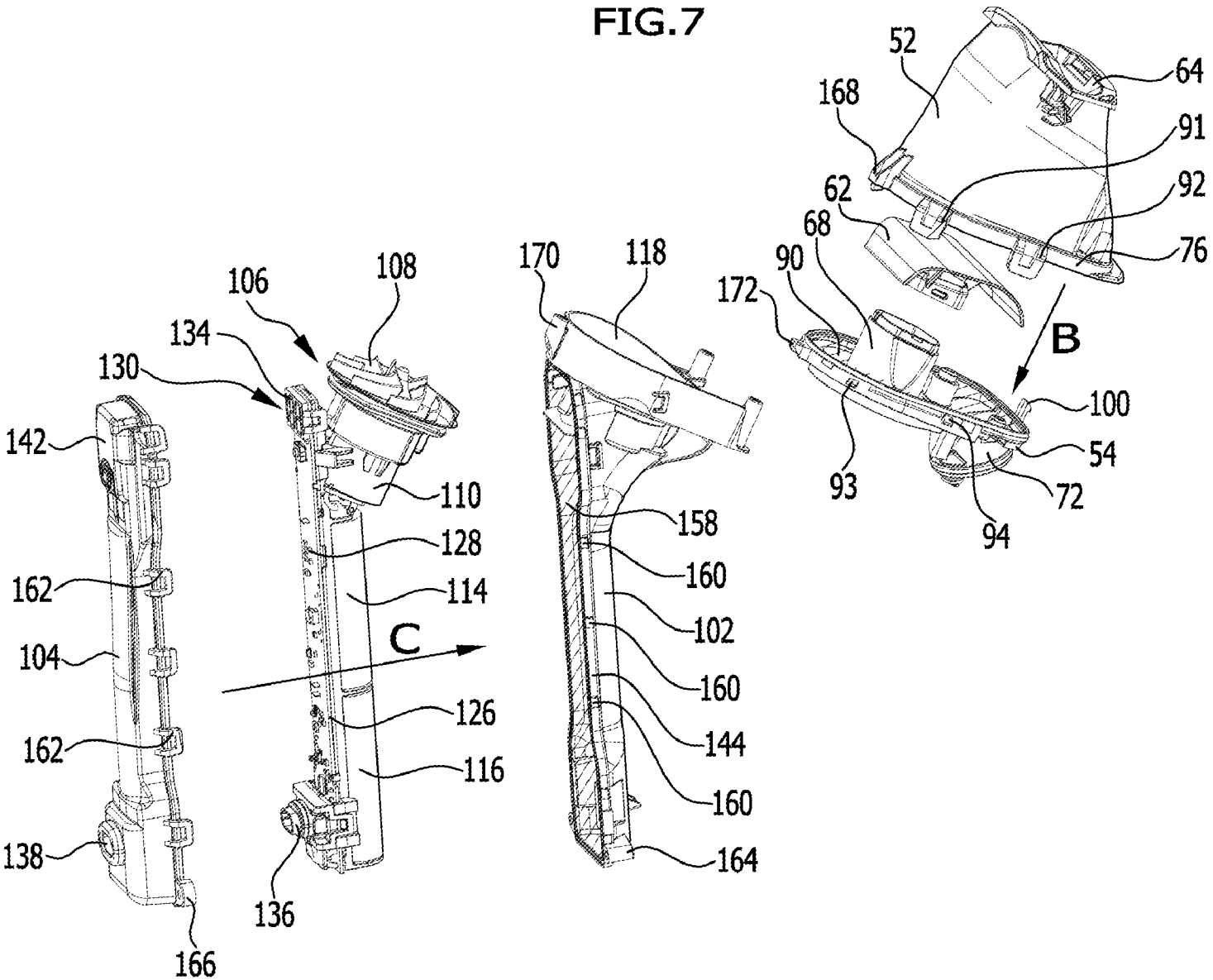
FIG. 7 shows a perspective depiction of the inner housing arrangement in the manner of an exploded illustration.
Figure 8:
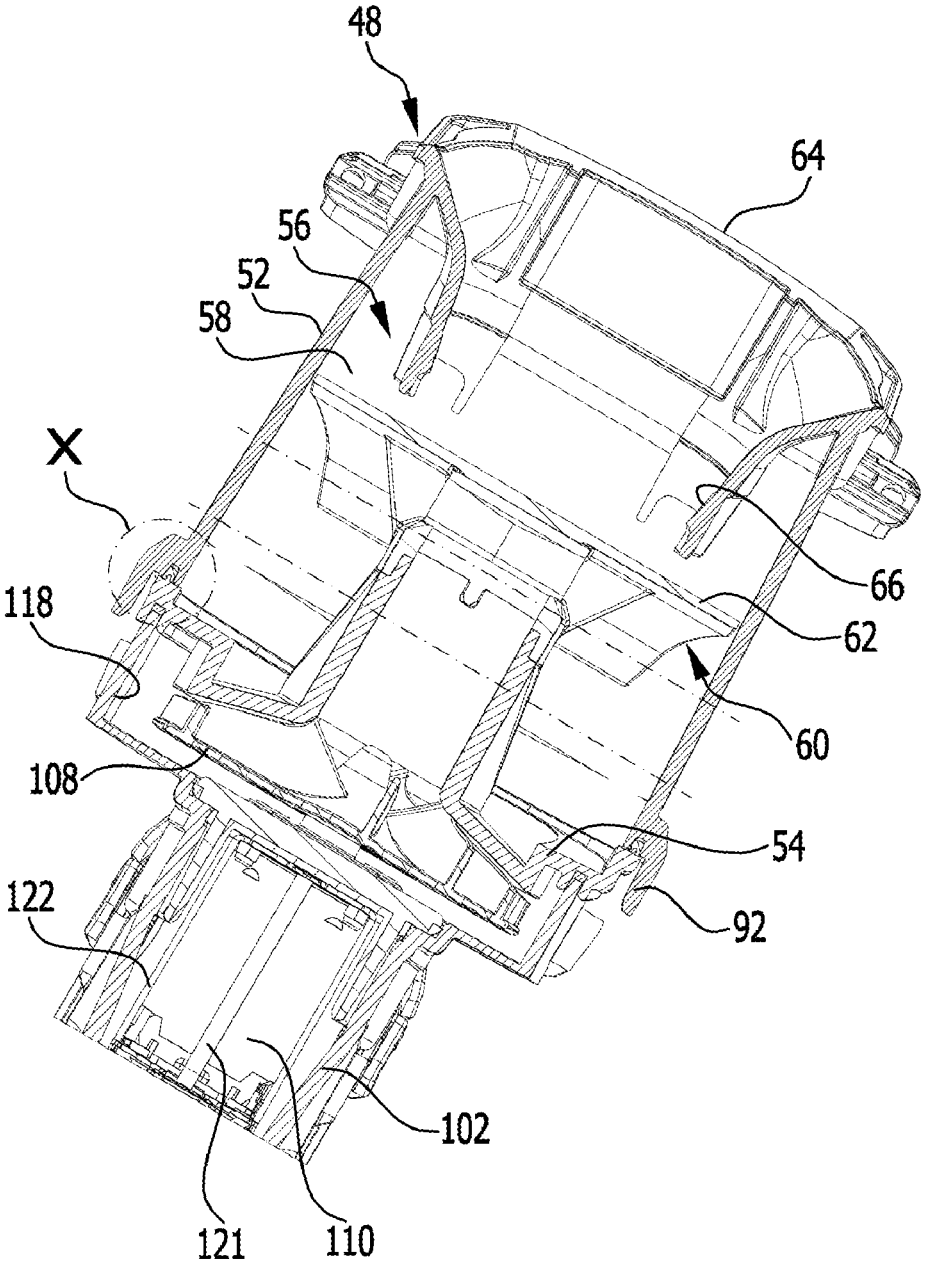
FIG. 8 shows a sectional view of the inner housing arrangement along line 8-8 in FIG. 6.
Figure 9:
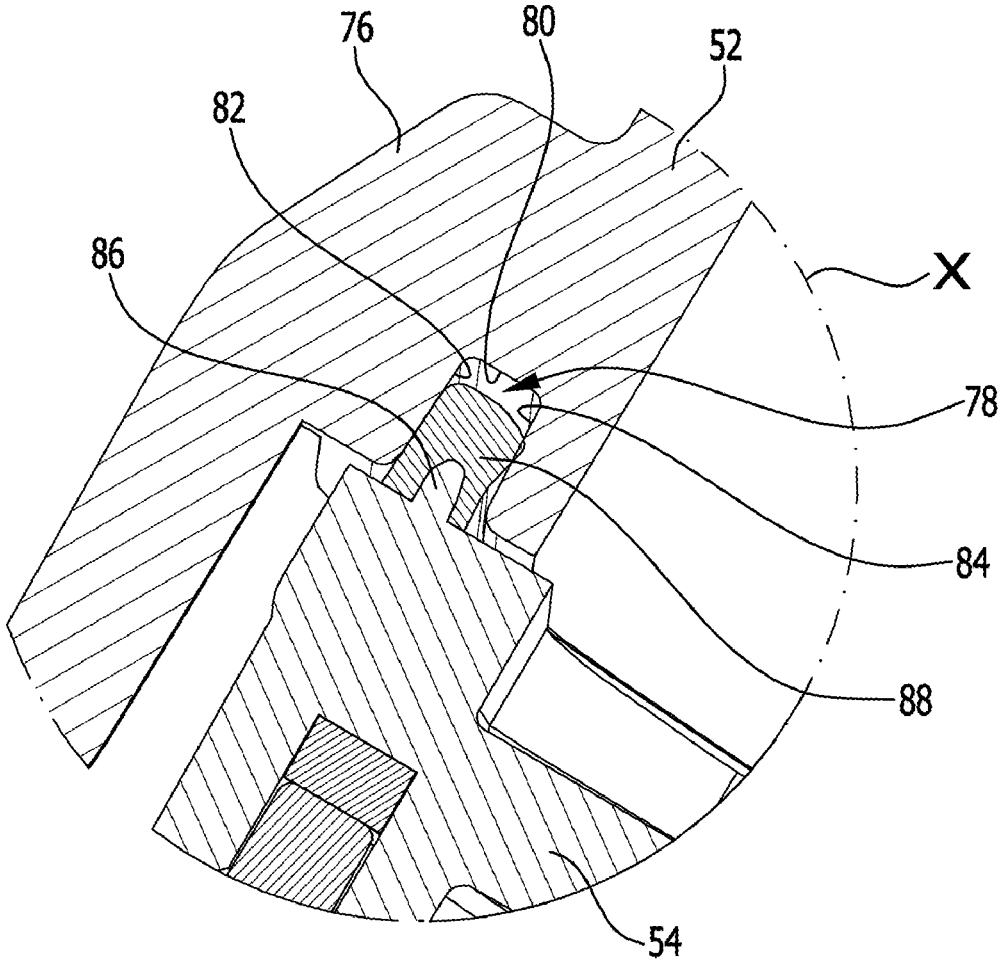
FIG. 9 shows an enlarged depiction of detail X in FIG. 8.
Figure 10:
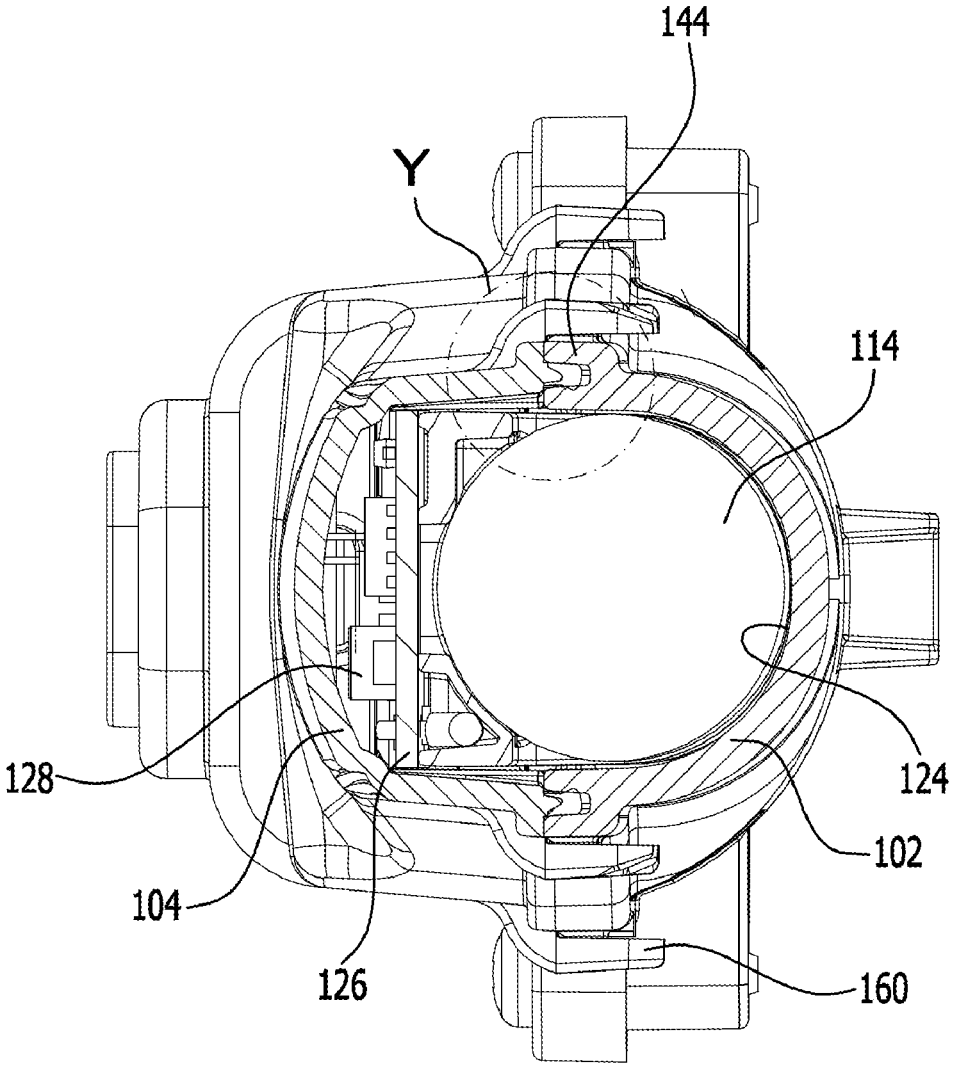
FIG. 10 shows a sectional view of the inner housing arrangement along line 10-10 in FIG. 6.
Figure 11:
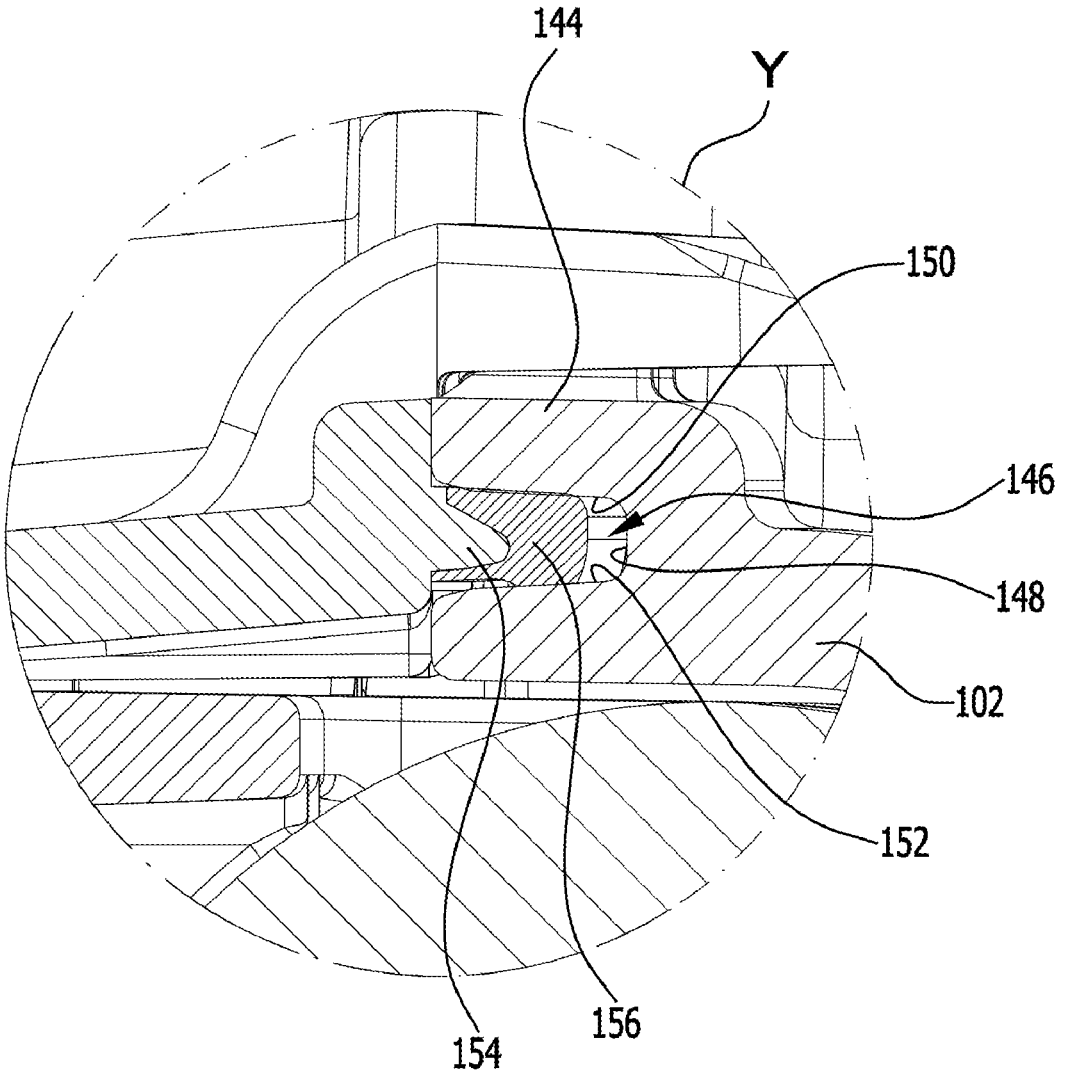
FIG. 11 shows an enlarged depiction of detail Y in FIG. 10.

The first separating housing part 52 is connected to the second separating housing part 54 in a liquid-tight manner. The first separating housing part 52 can be placed on the second separating housing part 54 in a first joining direction, which is shown in FIG. 7 by the arrow B. On an annular rim portion 76 facing the second separating housing part 54, the first separating housing part 52 comprises an annular groove 78, which is U-shaped in cross section, with a groove base 80 from which a first groove wall 82 and a second groove wall 84 project in the direction of the second separating housing part 54.

The second housing part 54 bears facing toward the annular groove 78 of the first separating housing part 52 an annular collar 86 on which a first sealing element 88 is arranged. The first sealing element 88 surrounds the annular collar 86 and dips into the annular groove 78 upon joining the two separating housing parts 52, 54, wherein the first sealing element 88 is pressed perpendicularly to the first joining direction B against the first groove wall 82 and against the second groove wall 84. The two groove walls 82, 84 each form a first sealing face and, upon joining the two separating housing parts 52, 54, the first sealing element 88 comes into abutment in a liquid-tight manner with the first sealing faces of the two groove walls 82, 84.

The first sealing element 88 forms in combination with the second separating housing part 54 a one-part injection molded part, which comprises two components, namely a soft component in the form of the first sealing element 88 and a hard component in the form of the second separating housing part 54. The second separating housing part 54 may be made e.g. of an ABS material and the first sealing element 88 may be made e.g. of a rubber-like plastics material. The first separating housing part 52 is preferably made of the same material as the second separating housing part 54.

By pressing the first sealing element 88 in between the two groove walls 82, 84, a liquid-tight connection is reliably produced upon joining the two separating housing parts 52, 54, without all too great of requirements having to be placed on the dimensional stability of the two separating housing parts 52, 54.

The first sealing element 88 is configured as a sealing ring closed in itself, which extends along a periphery of a first planar surface region 90 oriented perpendicularly to the first joining direction B. This is made clear in particular in FIG. 7, in which the first surface region 90 is depicted hatched.

Outside of the first surface region 90, arranged along the outer periphery of the rim portion 76 are a plurality of first latching projections 91, 92, which cooperate with complementarily formed second latching projections 93, 94 in the sense of a latching connection, wherein the first latching projections 91, 92 each engage behind a second latching projection 93 and 94, respectively, upon joining the two separating housing parts 52, 54.

Outside of the first surface regions, also arranged on the second separating housing part 54 is a latching hook 100, which, upon joining the two separating housing parts 52, 54, dips into a latch receptacle, which is not depicted in the illustration, of the first separating housing part 52 associated with the latching hook 100.

The electrical housing 50 is formed by a first electrical housing part 102 and a second electrical housing part 104 and surrounds an electrical device 106. The electrical device 106 comprises a suction turbine 108 and an electric motor 110 as well as an electronic control system 112 and two rechargeable batteries 114, 116.

The first electrical housing part 102 comprises on its upper side facing the separating housing part 52 a trough-shaped turbine receptacle 118 into which the suction turbine 108 can be inserted. Moreover, the first electrical housing part 102 comprises a motor receptacle 120 into which the electric motor 110 can be inserted, the motor shaft 121 of which is non-rotatably connectible to the suction turbine 108. The electric motor 110 comprises a motor housing 122 which surrounds a stator and a rotor of the electric motor 110 in the typical manner.

The first electrical housing part 102 moreover comprises a battery receptacle 124 into which the two rechargeable batteries 114, 116 can be inserted.

The second electrical housing part 104 accommodates the electronic control system 112 with a circuit board 126 on which a plurality of electrical components 128 are arranged.

The electronic control system 112 is configured as an electronic control, switch, and charging system and comprises a display device 130 arranged on the circuit board 126, which is formed by a multitude of light-emitting elements 134. In addition, arranged on the circuit board 126 is a charging socket 136 to which the user can connect a charging cable in order to connect the batteries 114, 116 to an external charging device.

The second electrical housing part 104 comprises an opening 138 into which the charging socket 136 dips with the interposition of a sealing ring 140.

At the height of the display device 130, the second electrical housing part 104 comprises a light-transmissible housing portion 142, by way of which the light emitted by the display device 130 can pass through the second electrical housing part 104.

The second electrical housing part 104 can be placed on the first electrical housing part 102 in a second joining direction, which is shown in FIG. 7 by arrow C. The first electrical housing part 102 comprises a circumferential rim portion 144 which faces the second electrical housing part 104 and bears an annular groove 146 that is U-shaped in cross section with a groove base 148 from which a first groove wall 150 and a second groove wall 152 arranged at a distance from the first groove wall 150 project in the direction of the second electrical housing part 104. The second electrical housing part 104 comprises a circumferential annular collar 154 on which a second sealing element 156 is arranged. Upon joining the two electrical housing parts 102, 104, the second sealing element 156 dips into the annular groove 146, wherein it is pressed perpendicularly to the second joining direction C against the two groove walls 150, 152. The second sealing element 156 is configured as a second sealing ring closed in itself, which extends along the periphery of a planar second surface region 158. This is made clear in particular in FIG. 7, in which the second surface region 158 is depicted hatched. The second surface region 158 is oriented at an angle to the first surface region 90.

Outside of the second surface region 158, arranged along the outer periphery of the rim portion 144 are a multitude of third latching projections 160 which, upon joining the two electrical housing parts 102, 104, each cooperate in the sense of a latching connection with a fourth latching projection 162 arranged outside of the second annular surface 158 on the outer side of the second electrical housing part 104. In relation to the second joining direction C, the third latching projections 160 are hereby each engaged from behind by a fourth latching projection 162.

In addition to the third latching projections 160, arranged on the outer side of the rim portion 144 of the first electrical housing part 102 are a plurality of first screw receptacles 164, and the second electrical housing part 104 bears on its outer side a plurality of second screw receptacles 166, which in relation to the second joining direction C are each oriented in alignment with a first screw receptacle 164 and each can be passed through by a connecting screw, such that the two electrical housing parts 102, 104 can not only be latched to each other but also can be screwed to each other.

The separating housing 48 is releasably connectible to the electrical housing 50. For this purpose, arranged on the outer side of the first separating housing part 52 and thus outside of the first surface region 90 are a plurality of third screw receptacles 168 distributed over the periphery of the rim portion 76, which each are associated with a fourth screw receptacle 170 arranged outside of the turbine receptacle 118 on the first electrical housing part 102. A respective third screw receptacle 168 can be passed through by a connecting screw, not depicted in the illustration, which can be screwed into a fourth screw receptacle 170. The connecting screws extend outside of the first surface region 90 and the second separating housing part 54 adopts a position between the first separating housing part 52 and the first electrical housing part 102 and is clamped between said two housing parts.

The inner housing arrangement 32 together with the separating device 56 and the electrical device 106 forms an assembly of the hard surface cleaning appliance 10, which can be prefabricated in large quantities. The prefabricated assembly may then be enclosed by the outer housing arrangement 30, the design of which can be optimized largely independently of the technical requirements that are placed on the inner housing arrangement 32.

In order to enable access to the charging socket 136, the first outer housing part 34 comprises a first perforation 174 and the third outer housing part 38 comprises a second perforation 176. Upon the assembly of the hard surface cleaning appliance 10, the perforations 174 and 176 are oriented in alignment with the opening 138 of the second electrical housing part 104, wherein the first perforation 174 of the first outer housing part 34 adopts a position between the second perforation 176 of the third outer housing part 38 and the opening 138 of the second electrical housing part 104.

In order to be able to recognize letters and digits displayed on the display device 130, the first outer housing part 34 comprises at the level of the display device 130 a third perforation 178, which is covered by a light-transmissible lid 180 that can be inserted into the third perforation 178 upon the assembly of the hard surface cleaning appliance 10.

For cleaning a hard surface, in particular a window pane, the portable hard surface cleaning appliance 10 can be moved along the hard surface to be cleaned in the manner of a manual window squeegee, wherein liquid located on the hard surface collects at the suction opening 22. Under the effect of the suction flow caused by the suction turbine 108, the liquid together with suction air can be suctioned from the hard surface. The mixture of liquid and suction air is able to flow through the suction conduit 24 to enter the separating chamber 58. Within the separating chamber 58, the liquid strikes the separating element 60 and is thereby separated from the suctioned mixture of liquid and air. The separated liquid can then enter the liquid tank 18 via the liquid outlet channel 72. The suction air can reach the suction turbine 108 via the air inlet opening 70 and the air outlet channel 68 and can be released from said suction turbine 108 into the environment via exhaust air openings, which are not depicted in the illustration.

The drive of the suction turbine 108 is effected by means of the electric motor 110, which can be controlled by the electronic control system 112.

As already mentioned, the separated liquid is collected in the liquid tank 18, which must be emptied from time to time. For this purpose, the user can remove the liquid tank 18 from the tank receptacle 74. The emptied liquid tank 18 may then be replaced into the tank receptacle 74.

The invention claimed is:

1. A portable hard surface cleaning appliance for squeegeeing and suctioning a liquid from a hard surface, in particular from a window pane, comprising:

a suction nozzle, which has a suction opening at which at least one squeegee lip is arranged;

an electrical device, which has a suction turbine in flow connection with the suction nozzle for suctioning a liquid air mixture from the suction opening, an electric motor, an electronic control system, and at least one rechargeable battery;

a separating device, which is arranged in a flow path between the suction nozzle and the suction turbine for separating liquid from the suctioned liquid air mixture; and a liquid tank for receiving the separated liquid, wherein the hard surface cleaning appliance comprises an inner housing arrangement and an outer housing arrangement, wherein the inner housing arrangement accommodates the separating device and the electrical device, and the outer housing arrangement surrounds the inner housing arrangement, wherein the inner housing arrangement comprises a separating housing, in which the separating device is arranged and which comprises a first separating housing part and a second separating housing part, which are connectible to each other in a liquid-tight manner wherein one of the first and second separating housing parts comprises an inlet channel into which an end portion of a suction conduit of the suction nozzle dips.

2. The portable hard surface cleaning appliance in accordance with claim 1, wherein the first and second separating housing parts are connectible to each other in a first joining direction, wherein arranged on one of the first and second separating housing parts is a first sealing element which is pressable perpendicularly to the first joining direction against at least one first sealing face that is arranged on an other of the first and second separating housing parts.

3. The portable hard surface cleaning appliance in accordance with claim 2, wherein the first separating housing part comprises an annular groove with a groove base and with two groove walls arranged at a distance from each other, wherein at least one groove wall forms the at least one first sealing face, and wherein the first sealing element is arranged on the second separating housing part and, upon joining the first and second separating housing parts, dips into the annular groove and is pressable against the at least one first sealing face.

4. The portable hard surface cleaning appliance in accordance with claim 3, wherein the first sealing element is molded onto the second separating housing part.

5. The portable hard surface cleaning appliance in accordance with claim 4, wherein the first sealing element and the second separating housing part together form an injection molded part with a soft component and a hard component, wherein the first sealing element forms the soft component of the injection molded part and the second separating housing part forms the hard component of the injection molded part.

6. The portable hard surface cleaning appliance in accordance with claim 2, wherein the first sealing element is configured as a first sealing ring closed in itself, which surrounds a first planar surface region oriented perpendicularly to the first joining direction.

7. The portable hard surface cleaning appliance in accordance with claim 6, wherein arranged outside of the first planar surface region are first fixing elements for fixing the first separating housing part to the second separating housing part.

8. The portable hard surface cleaning appliance in accordance with claim 7, wherein the first fixing elements comprise latching elements and/or screw elements.

9. The portable hard surface cleaning appliance in accordance with claim 1, wherein one of the first and second separating housing parts is releasably connectible to the suction nozzle.

10. The portable hard surface cleaning appliance in accordance with claim 1, wherein one of the first and second separating housing parts comprises an air outlet, by way of which the separating housing is in flow connection with the suction turbine.

11. The portable hard surface cleaning appliance in accordance with claim 1, wherein one of the first and second separating housing parts comprises a liquid outlet, by way of which the one of the first and second separating housing is in flow connection with the liquid tank.

12. The portable hard surface cleaning appliance in accordance with claim 1, wherein the inner housing arrangement comprises an electrical housing in which the electrical device is arranged and which comprises a first electrical housing part and a second electrical housing part that are connectible to each other in a liquid-tight manner.

13. The portable hard surface cleaning appliance in accordance with claim 12, wherein the first and second electrical housing parts are connectible to each other in a second joining direction, wherein arranged on one of the first and second electrical housing parts is a second sealing element which is pressable perpendicularly to the second joining direction against at least one second sealing face that is arranged on an other of the first and second electrical housing parts.

14. The portable hard surface cleaning appliance in accordance with claim 13, wherein the first electrical housing part comprises an annular groove with a groove base and with two groove walls arranged at a distance from each other, wherein at least one of the two groove walls forms the at least one second sealing face, and wherein the second sealing element is arranged on the second electrical housing part and, upon joining the first and second electrical housing parts, dips into the annular groove and is pressable against the at least one second sealing face.

15. The portable hard surface cleaning appliance in accordance with claim 14, wherein the second sealing element is molded onto the second electrical housing part.

16. The portable hard surface cleaning appliance in accordance with claim 15, wherein the second sealing element and the second electrical housing part together form an injection molded part with a soft component and a hard component, wherein second sealing component forms the soft component of the injection molded part and the electrical housing part forms the hard component of the injection molded part.

17. The portable hard surface cleaning appliance in accordance with claim 13, wherein the second sealing element is configured as a second sealing ring closed in itself, which surrounds a second planar surface region oriented perpendicularly to the second joining direction.

18. The portable hard surface cleaning appliance in accordance with claim 17, wherein arranged outside of the second planar surface region are second fixing elements for fixing the first electrical housing part to the second electrical housing part.

19. The portable hard surface cleaning appliance in accordance with claim 18, wherein the second fixing elements comprise latching elements and/or screw elements.

20. The portable hard surface cleaning appliance in accordance with claim 12, wherein one of the first and second electrical housing parts comprises a motor receptacle into which the electric motor is insertable.

21. The portable hard surface cleaning appliance in accordance with claim 20, wherein the electric motor comprises a motor housing.

22. The portable hard surface cleaning appliance in accordance with claim 12, wherein one of the first and second electrical housing parts comprises a turbine receptacle into which the suction turbine is insertable.

23. The portable hard surface cleaning appliance in accordance with claim 12, wherein one of the first and second electrical housing parts comprises a battery receptacle into which the at least one rechargeable battery is insertable.

24. The portable hard surface cleaning appliance in accordance with claim 12, wherein the electronic control system is insertable into one of the first and second electrical housing parts and comprises at least one circuit board on which electrical components are arranged.

25. The portable hard surface cleaning appliance in accordance with claim 24, wherein the electronic control system comprises at least one light-emitting element which is arranged on a circuit board, and wherein one of the first and second electrical housing parts comprises a housing portion which covers the at least one light-emitting element and is light-transmissive.

26. The portable hard surface cleaning appliance in accordance with claim 25, wherein the at least one light-emitting element forms a display device on which plain text is displayable.

27. The portable hard surface cleaning appliance in accordance with claim 1, wherein the inner housing arrangement comprises an electrical housing in which the electrical device is arranged and which comprises a first electrical housing part and a second electrical housing part that are connectible to each other in a liquid-tight manner, and wherein the separating housing is releasably connectible to the electrical housing.

28. The portable hard surface cleaning appliance in accordance with claim 1, wherein the outer housing arrangement comprises an outer housing jacket, which is formed by a first outer housing part and a second outer housing part and surrounds the inner housing arrangement in a circumferential direction.

29. The portable hard surface cleaning appliance in accordance with claim 28, wherein the outer housing arrangement comprises a third outer housing part which covers an underside of the inner housing arrangement that is remote from the suction nozzle.

* * * * *